US006126420A

United States Patent [19]

Eisenmann

[11] Patent Number: 6,126,420

[45] Date of Patent: Oct. 3, 2000

[54] INFINITELY VARIABLE RING GEAR PUMP

[76] Inventor: Siegfried Eisenmann, Conchesstr. 25, 88326 Aulendorf, Germany

[21] Appl. No.: 08/984,794

[22] Filed: Dec. 4, 1997

[30] Foreign Application Priority Data

| | | | |
|---|---|---|---|
| Dec. 4, 1996 | [DE] | Germany | 296 21 073 U |
| Feb. 25, 1997 | [DE] | Germany | 297 03 369 U |
| Jul. 23, 1997 | [EP] | European Pat. Off. | 97 112 646 |

[51] Int. Cl.[7] ..... F01C 21/16

[52] U.S. Cl. ..... 418/19; 418/31; 417/219

[58] Field of Search ..... 418/19, 31; 417/219

[56] References Cited

U.S. PATENT DOCUMENTS

| | | | |
|---|---|---|---|
| 1,486,836 | 3/1924 | Hill | 418/19 X |
| 4,097,204 | 6/1978 | Palmer | 418/19 |

FOREIGN PATENT DOCUMENTS

| | | | |
|---|---|---|---|
| 258797A | 3/1988 | European Pat. Off. . | |
| 4231690A | 3/1994 | Germany . | |
| 63-1781 | 1/1988 | Japan | 418/19 |

*Primary Examiner*—Hoang Nguyen
*Attorney, Agent, or Firm*—Renner, Otto, Boisselle & Sklar, LLP

[57] ABSTRACT

An infinitely variable ring gear pump comprising a stationary casing, an internal rotor (3) in said casing rotatably supported and driven by means of a shaft (2) and an external rotor (4) likewise rotatably supported, meshing with the internal rotor (3), the difference in the number of teeth of the gear ring running set comprising the internal rotor (3) and the external rotor (4) being equal to unity, having a tooth shape in which a plurality of expanding and contracting displacement cells (7) each sealed off from the other materializes due to tooth tip contact and kidney-shaped low and high-pressure ports (8, 9) fixedly arranged laterally in the region of the displacement cells (7) being provided in the casing, the ports (8, 9) being separated from each other by webs (10, 11) and the angular position of the eccentric axis (eccentricity 17) of the ring gear running set (5) being variable relative to the casing. The support (12) of the external rotor (4) of the ring gear running set (5) occurs at the outer diameter (13) of the latter in an adjusting ring (14) preferably the same in width which is rollable with zero slip by its outer circumferential or pitch circle (15) on an inner circumferential or pitch circle (16). The difference in the diameters of the two circumferential or pitch circles (15, 16) equals twice the eccentricity (17) of the ring gear running set (5).

23 Claims, 14 Drawing Sheets

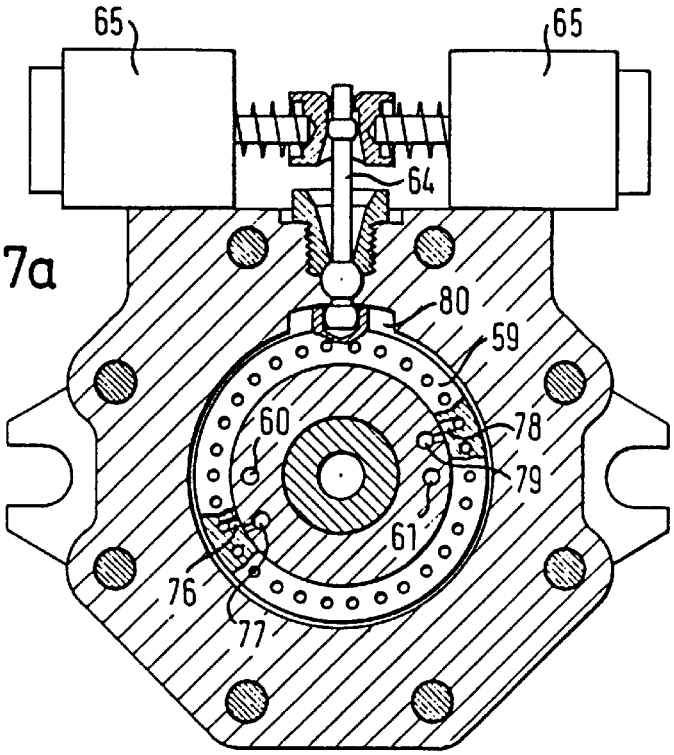
Fig. 7a
Fig. 7b
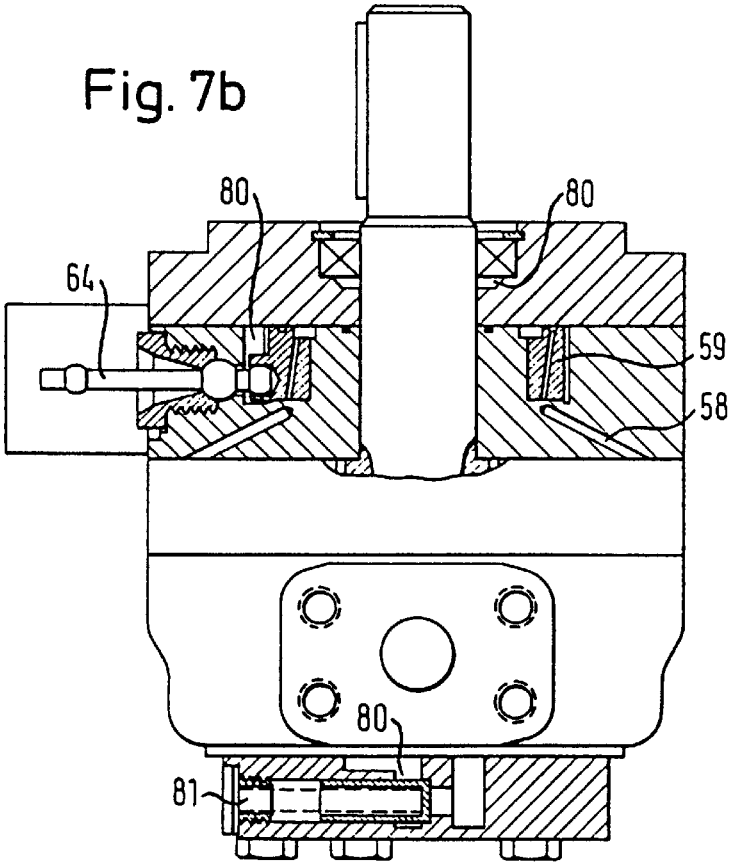

INFINITELY VARIABLE RING GEAR PUMP

BACKGROUND OF THE INVENTION

1. Field of the Invention

The invention relates to an infinitely variable ring gear pump comprising a stationary casing, an internal rotor in the casing rotatably supported and driven by means of a shaft and an external rotor likewise rotatably supported, meshing with the internal rotor, the difference in the number of teeth of the gear ring running set comprising the internal rotor and the external rotor being equal to unity, having a tooth shape in which a plurality of expanding and contracting displacement cells each sealed off from the other materialize, due to tooth tip contact and kidney-shaped low and high pressure ports fixedly arranged laterally in the region of the displacement cells being provided in the casing, the ports being separated from each other by webs and the angular position of the eccentric axis (eccentricity) of the ring gear running set being variable relative to the casing, wherein the support or bearing of the external rotor of the ring gear running set occurs at an outer diameter of the latter in an adjusting ring preferably the same in width which is rollable with zero slip by its outer circumferential or pitch circle on an inner circumferential or pitch circle and the difference in the diameters of the two circumferential or pitch circles equals twice the eccentricity of the ring gear running set. The specific delivery (displacement/speed) of the variable ring gear pump in accordance with the invention can be varied.

2. Description of the Prior Art

Known gear pumps feature a specific delivery which is constant due to the system involved, because the geometry of the displacement "cells" cannot be varied. The expanding and contracting displacement cells fluctuate during rotation of the gear set from a minimum to a maximum and back to a minimum, because the teeth are rigid and non-variable. This constancy in the specific delivery automatically results in the delivery of the pump being proportional to its rotary speed as long as the displacement cells are filled 100%.

However, in many applications this proportionality is a nuisance and undesirable. Although in a press, for instance, a high hydraulic fluid delivery is necessary for the rapid advance, whereas in the final phase of the working stroke only high pressure is still delivered, the hydraulic fluid delivery requirement drops to zero. Since the drive speed of such pumps as a rule remains constant, excess delivery materializes at high pressure which is returned to the fluid reservoir with a loss in energy.

This excess delivery is particularly a nuisance, for example, in the case of engine lubricating pumps on motor vehicles and in the case of oil supply pumps on automatic transmissions. Although these require at low engine speed and thus lower pump speeds a minimum delivery needed for idling and a minimum oil pressure at high speeds, the oil flow required at higher speeds is way below the proportionality line, however, it being mostly less than a third of the proportionality flow at maximum speeds.

Aside from the many efforts made in solving this problem by suction throttling, solutions involving variable vane-type pumps have been proposed. Also known are solutions involving two-register pumps for achieving at least two delivery stages or involving two running sets operating variable relative to each other.

One good approach to solving the problem is a ring gear pump as an internal gear pump requiring no crescent due to the gear shape being selected so that by tooth tip contact each tooth chamber is reliably sealed off from the adjacent tooth chambers so that a good volumetric efficiency is achieved. In such ring gear pumps there is the possibility of varying the axial spacing of the internal rotor from the external rotor or the angular location of the eccentric axis relative to the casing and thus relative to the supply and discharge ports in the casing.

One design solution could consist of supporting or bearing the external rotor in a cam ring rotatably arranged variable in the casing. For near zero adjustment of delivery needed in practical application as is highly desirable in cold starting, a 90° angular adjustment of the cam or eccentric axis is needed. This means that the cam ring for adjusting the eccentric axis of the running set needs to be turned through 90° and thus over a large perimeter, this in turn requiring a very large travel of the governor spring which would result in dimensions which are very difficult to achieve due to the necessary soft spring characteristic. Since especially in the case of motor vehicle engines and automatic transmissions very frequent and fast changes in speed occur, the cam ring would have to experience high rotary accelerations and delays which would result in high adjusting forces, high resistance thereto and high wear. Also, the risk of soilage of the large governing spaces is high.

SUMMARY OF THE INVENTION

The invention solves the problem of small governing travel and fast reaction in governing variable ring gear pumps by means of the supporting or bearing of the external rotor of the ring gear running set occurring at the outer diameter of the latter in an adjusting ring preferably the same in width which is rollable with zero slip by its outer circumferential or pitch circle on an inner circumferential or pitch circle and the difference in the diameters of the two circumferential or pitch circles equals twice the eccentricity of the ring gear running set.

In keeping with the laws of internal gearing the negative ratio of angle of rotation of the eccentric axis or of the planet carrier to the angle of rotation of the pinion or planet gear equals the number of teeth of the pinion when the difference in the number of teeth between annulus and pinion is unity. Since in accordance with claim 1 the circumferential or pitch circle of the external toothing on the adjusting ring is relatively large, e.g. the number of teeth being 16, the negative angular adjustment of the eccentric axis is 16-times the angle of rotation of the adjusting ring about its own axis. Accordingly, the adjusting ring executes small angular rotations and thus small adjusting travel since it executes merely a small rolling movement in the casing.

In this arrangement it merely needs to be satisfied that the difference in diameter of the circles rolling internally on each other equals twice the eccentricity of the gear running set so that the axial spacing of the gears remains precisely constant during the complete governing action. Furthermore, the circles roll on each other with zero slip.

To ensure rolling with zero slip an aspect in accordance with the invention is proposed in which the circumferential or pitch circles of the adjusting ring and the casing are formed by the pitch circles of an adjusting gear configured as a complete or partial internal gear having the same eccentricity as the eccentricity of the ring gear running set.

Due to the small adjusting movement of the adjusting ring there is now also the possibility of achieving a reversible pump at reasonable constructional expense in which means are provided permitting mechanical actuation of the governing rolling movement of the adjusting ring in both directions from the deadhead position (zero position) of the ring gear pump into the delivery position, this being a prerequirement for the construction of hydrostatic drives and controls which always also require a reversal in the direction of rotation.

Preferably the toothing of an adjusting gear configured as an internal gear is a trochoid or cycloid internal toothing between the adjusting ring and the casing.

In the cam angle range in which the intake of the pump is greatly reduced, i.e. in the region where the teeth of the ring gear running set of the pump pass the webs between the kidney-shaped ports of the casing forming the low and high-pressure ports, there is a risk of cavitation at the suction side and entrapment at the pressure side. To mollify the undesirable accompanying effects involved, the adjusting ring comprises, as viewed axially, on the side opposite the kidney-shaped low and high-pressure ports a peripheral connecting groove closed off by the casing wall which together with the connecting grooves machined in the casing wall connects the expanding and contracting displacement cells to each other in the region of the webs. A passage connection is proposed between these working chambers which permits a compensating oil flow so that excessive pressure peaks at the entrapment location and extreme underpressures at the cavitation location are avoided.

It is especially in the case of pumps required to deliver fluids having a very low viscosity, for example hot engine oil, that a good seal of all working, governing and pressure equalization spaces is mandatory. If, for instance, as disclosed in claim 5, the space between the inner circumference of the casing and the outer circumference of the adjusting ring serves as the governor piston, then it is of advantage to provide the precautions, wherein between the adjusting ring and the casing at least one sealed radially acting pressure field connected to the high pressure is arranged, this pressure field sealingly urging the adjusting ring at the opposite side as viewed radially by its tooth tips or tooth-tip similar parts against the tooth tips or tooth-tip similar parts of the casing, and/or, wherein on the casing at least one sealing member is provided, the sealing member comprising on its rear between the casing and the sealing member at least one sealed pressure field sealingly urging the at least one sealing member against the tooth tip(s) or tooth-tip similar parts of the adjusting ring, preferably by being exposed to high pressure.

The configuration of a zero-stroke pump, wherein the pressure-building working space is effective as an adjusting cylinder over the external rotor on the adjusting ring and a governor spring is provided biased to move the adjusting ring in the direction of maximum displacement, reduces the expense of the configuration by only the compression space in the ring gear pump handling the high pressure itself. Since however in regulating the delivery the momentary center, i.e. the point about which the adjusting ring rotates in every rotation position, changes in such a way that in the deadhead position of the adjusting ring the hydrostatic force component of the working space to be sealed no longer exerts a moment on the adjusting ring, the pump is not regulated totally to zero when a spring is used. In this case the working space also exposed to high-pressure features the largest cross-sectional surface area axially which may under certain circumstances result in prohibitively high axial deflection of the casing and more particularly of the cover. This is why sealing means as set forth above are preferably provided. These features of the ring gear pump in accordance with the invention may under certain circumstances prove to be even more of an advantage using known means since it is usual to save costs in engine building to configure the casing mostly of die-cast aluminum, the running set and the adjusting ring of sintered metal and the cover often of sheet metal. Furthermore, the expense of machining the casing should be minimized by it being restricted mostly to turning, drilling and milling using tools powered by NC lathes.

The external toothing of the adjusting gear is produced preferably integrally with the adjusting ring, more particularly by sintering. The external toothing may also be formed principally by a stamped ring of sheet metal on the adjusting ring. The internal toothing may be formed to advantage on the casing by means of a stamped ring of sheet metal. In another embodiment the internal toothing of the adjusting gear is configured integral with the casing which is then preferably sintered together with the internal toothing. The internal rotor of the pump may be shrunk into place on the shaft, axial connecting passages being preferably provided between the shrink seat of the shaft and the internal rotor. In an alternative embodiment the internal rotor is configured integrally with the shaft.

If the ring gear pump in accordance with the invention is to be employed as a high-pressure pump, then high demands need to be satisfied by the design, it being particularly advantageous when the teeth of the ring gear running set are configured on one of the two rotors as rollers to avoid heavy wear, this also having a proven record of success in slow-running high-pressure rotary piston machines.

So that the machine is not excessive in diameter the rollers are preferably arranged on the internal rotor.

In this arrangement especially rugged conditions and small compact dimensions are achieved when the internal rotor is configured integrally with the shaft as the support for the rollers.

Due to the large surface areas exposed to the effects of the high pressure considerable deformation forces occur, particularly at the adjusting ring, in the operation of such ring gear pumps. Since these surface areas need to simultaneously form the sliding support for the highly loaded external rotor the hydrostatic force acting from inside out is more or less compensated from outside inwards. This can be achieved by the adjusting ring and thus the toothing of the adjusting gear extending over the full width of the pump running set and the toothing of the adjusting gear forming pressure-tight chambers which may be exposed to the working pressure or partially to a high pressure, as a result of which the forces are compensated radially at the adjusting ring so that the deformations can be reduced at least to a major extent.

The radial compensating force may then also be made use of to vary the delivery of the ring gear pump to advantage when the chambers in the toothing of the adjusting gear can be varied both as to their number and as regards their rotational location via passages and preferably via a rotary control valve within optional limits as may also be put to use in the case of the aforementioned slow-running high-pressure reversible pump machines. The angle of the rotary control valve is variable by means for varying the location of the chambers exposed to a high pressure and low pressure. The moment required for varying the position of the adjusting ring materializes by the resulting force vector of the partial pressure field in the toothing chambers of the adjusting gear exposed to pressure, preferably to a high pressure, being directed past the momentary center M as the fulcrum so that due to rotation of the pressure field a lever arm simultaneously materializes. The adjusting ring will then turn in the toothing of the adjusting gear until equilibrium exists between the adjusting moment and the moment exerted by the working pressure field relative to the new momentary center M in the counter-turning direction.

Especially in the case of a ring gear pump for a closed-circuit application it is of advantage to provide at the end of the pump shaft opposite the drive stub a scavenging and governing pump which by known ways and means replaces the external leak-off via check valves in the low pressure range with a greatly reduced pressure.

Restrictors are provided preferably in the passages to the rotary control valve and the rotary control valve comprises spill ports to connect the chambers in the leak-off spaces to the tank.

This type of pressure compensation and varying the delivery of the ring gear pump in accordance with the invention necessitates precise machining of the toothing of the adjusting gear so that the leakage losses from the compensating and governor field into the suction area or into the leak-off spaces, i.e. the so-called leakage losses of the ring gear pump, remain within reasonable limits. This is all the more important in the case of a variable-delivery pump since the leakage percentage involved in the effective delivery increases in any case when the pump is deadheaded [Trans. Note: regulated to or almost to zero delivery] at even pressure so that the volumetric efficiency drops off correspondingly strongly.

When, on the other hand, varying the delivery of the adjusting ring is not done directly hydraulically, as described above, but mechanically, as set forth in claim 6, then the cells between the teeth of the adjusting gear exposed to high pressure merely serve to compensate the forces and thus the stress in the adjusting ring to minimize deformation thereof. In this case the number and selection of the cells exposed to high pressure can be selected so that the adjusting ring always sealingly maintains the tips of the toothing of the adjusting gear in contact due to the internal working pressure field. In this case both parts, i.e. the adjusting ring with its external toothing and the casing ring with its internal toothing, can be produced with sufficient accuracy by sintering. Then, namely, sufficient backlash can be provided to compensate production tolerances.

In the case of a high-pressure pump an extremely compact design is a mandatory requirement. The spaces exposed to the pressure must not comprise any large effective surface areas subject to a high pressure. This is why in the case of a zero-stroke pump the aspect is preferred, wherein a spring force strives to turn the adjusting ring in the direction of maximum delivery; preferably the spring force is transmitted by means of a pressure member to a tooth flank of the external toothing of the adjusting ring. Here too there is the problem that delivery cannot be deadheaded totally to zero should only the pressure space of the internal ring gear pump be employed as the adjusting force in the direction of the zero stroke, since in this position no further adjusting moment relative to the momentary pole of the adjusting ring is available. The means available for remedying this situation involves the adjusting ring which with increasing rotation exposes suitable passages or at least one such passage which guide(s) the high pressure in such cells in the auxiliary toothing between adjusting ring and casing part to promote rotation of the adjusting ring in the direction of zero stroke.

When the toothing between the adjusting ring and the casing part is produced by sintering there is the requirement, as already mentioned, that optimum sealing occurs by tooth tip contact in the toothing. This is affected not only by the working pressure field in under-compensation but also by the radial components of the tooth force at the momentary center M. This is why it is of advantage to select for the toothing of the adjusting gear a tooth shape featuring a large angle of engagement at the point of full mesh. This requirement is met by a trochoid toothing having circular or hypocycloidal teeth in the annulus.

The axial runout of the adjusting ring in the casing is configured to advantage substantially smaller than the axial runout of the ring gear running set.

BRIEF DESCRIPTION OF THE DRAWINGS

Preferred example embodiments of the invention will now be explained with reference to the drawing in which:

FIG. 7*a* is a cross-section through the pump as shown in FIGS. 6*a* and 6*b*, FIG. 7*b* is a partial section view of the pump as shown in FIGS. 6*a* to 7*a*.

DESCRIPTION OF THE PREFERRED EMBODIMENTS

Figure 1A:
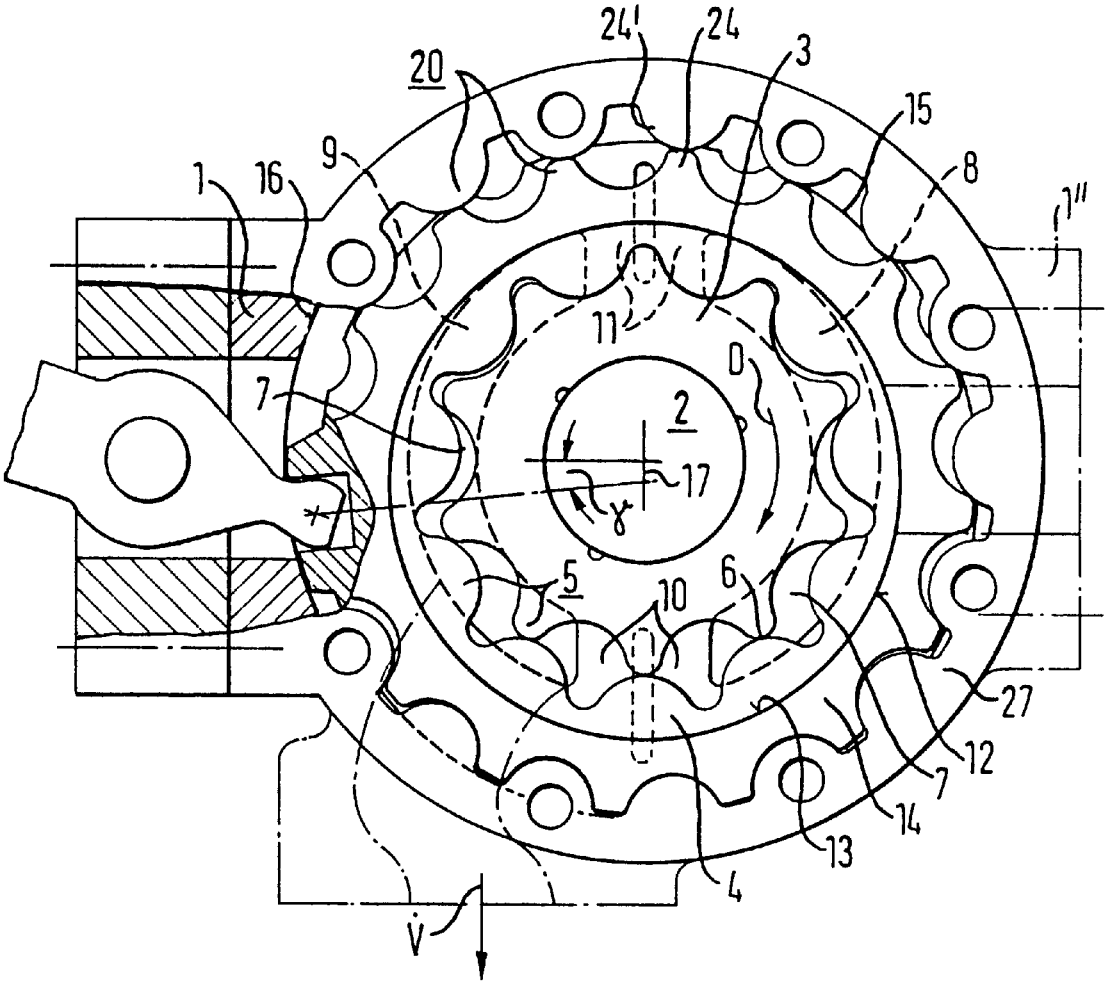
FIG. 1*a* shows a first example embodiment of a reversible pump in a first end position of maximum delivery.
Figure 1B:
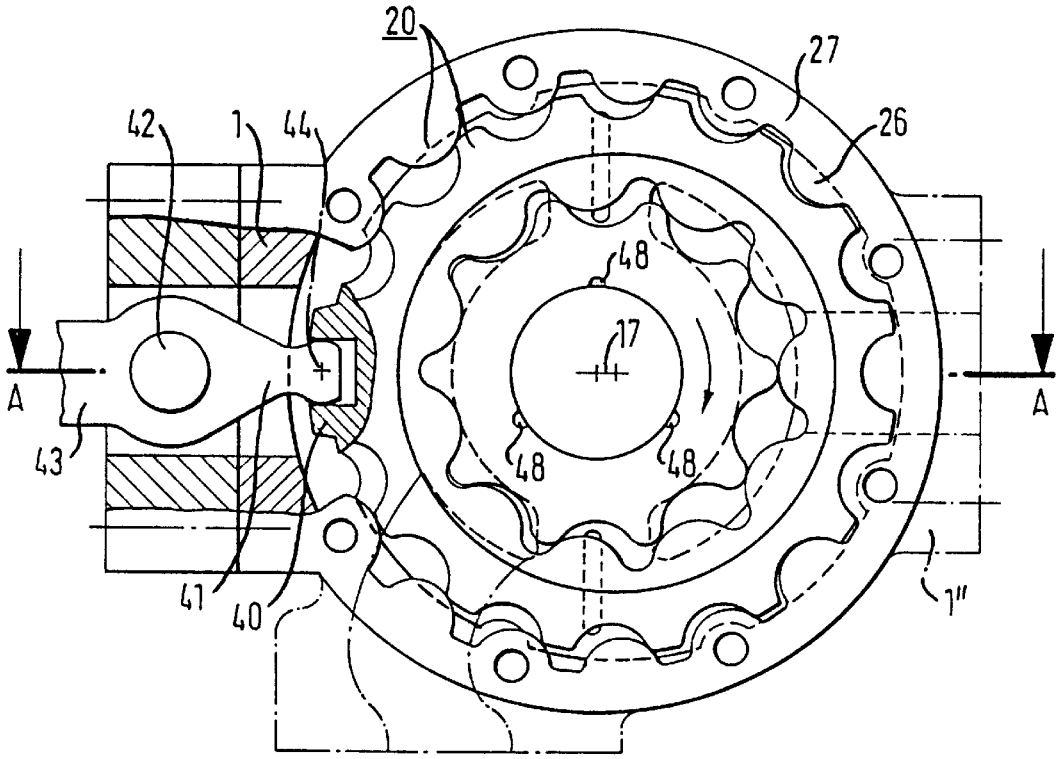
FIG. 1*b* is the reversible pump as shown in FIG. 1*a* in its zero position.
Figure 1C:
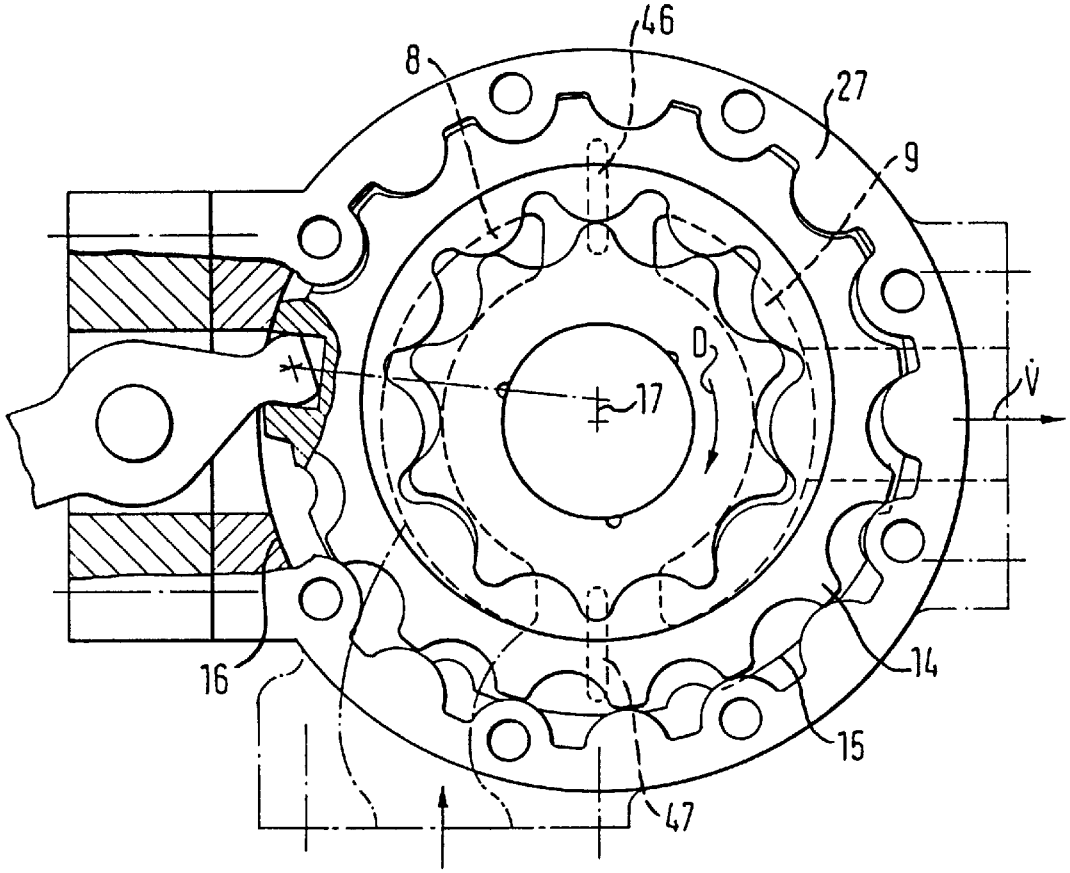
FIG. 1*c* is the reversible pump as shown in FIGS. 1*a* and 1*b* in a second end position of maximum delivery.
Figure 2:
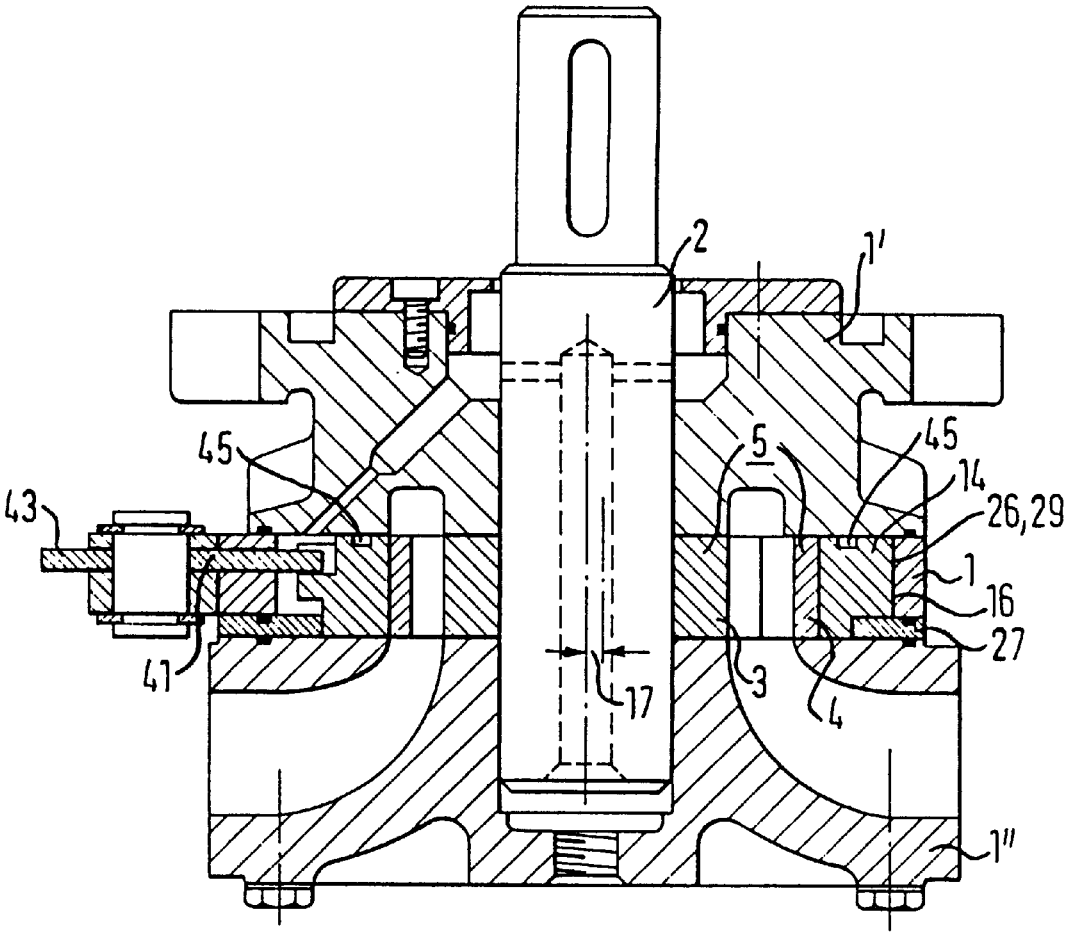
FIG. 2 is a longitudinal section through the pump as shown in FIGS. 1*a*–1*c*.

A ring gear pump illustrated in the FIGS. 1*a* to 2 comprises an internal rotor 3 and an external rotor 4 which form by their external and internal toothing a ring gear running set 5. The external toothing of the internal rotor 3 has one tooth less than the internal toothing of the external rotor 4.

The internal rotor 3 is shrink-mounted on a rotary-driven shaft 2. Provided between the shaft shrink-mount and the internal rotor 3 are axial connecting passages 48.

Both the shaft 2 and thus the internal rotor 3 as well as the external rotor 4 are rotatively supported in a pump casing, the parts of which are identified by 1, 1' and 1". The rotational axis of the external rotor 4 runs parallel spaced away from, i.e. eccentric, to the rotational axis of the internal rotor 3, this eccentricity or spacing between the two rotational axes being identified by 17.

The internal rotor 3 and the external rotor 4 form in-between a fluid delivery space. This fluid delivery space is divided into displacement cells 7 each sealed off from the other. Each of the individual displacement cells 7 is formed between two teeth in sequence of the internal rotor 3 and the internal toothing of the external rotor 4 by every two teeth in sequence of the internal rotor having tip and flank contact 6 with every two teeth in sequence of the opposite teeth of the internal toothing of the external rotor 4.

In the casing lateral to the displacement cells 7 adjoining kidney-shaped grooves 8 and 9 are machined which form a fluid supply and a fluid discharge to and from the displacement cells 7 respectively. In the position of the external rotor 4 as shown in FIG. 1*a* the groove 8 forms the low-pressure port for supply of the fluid and groove 9 forms the high-pressure port for the fluid discharge. The groove 8 extends from near a full mesh location in the region of a web 11 belonging to the casing in a near semicircular shape up to near an open mesh location which is covered by a further web 10 belonging to the casing diametrally opposing the web 11. The groove 9 on the high-pressure side as shown in FIG. 1*a* extends in the casing mirror-symmetrical to the groove 8 of the opposite side from the two webs 10 and 11. From the full mesh location at web 11 up to the open mesh location at web 10 the displacement cells 7 are configured increasingly larger in the direction of rotation D before subsequently becoming smaller from the open mesh location to the full mesh location. On rotary drive of the internal rotor 3 fluid is drawn in by the expanding displacement cells 7 in the region of the low-pressure port 8, transported via the open mesh location and re-discharged at high pressure through the high-pressure port 9. In the position as shown in FIG. 1*a* the rotational axis of the external rotor 4 is located on the straight line extending from the full mesh location via the rotational axis of the internal rotor 3 to the open mesh location, i.e. to the open mesh location offset relative to the rotational axis of the internal rotor 3. In this position of the eccentricity 17 and direction of rotation D maximum flow or maximum displacement from the low-pressure side 8 to the high-pressure side 9 is achieved.

To vary the flow rate "$\dot{V}$" the external rotor 4 is received by a ring 14 which in turn can be varied relative to the casing. Supported freely rotatable in this adjusting ring 14 is the external rotor 4 via its outer circumference 13 by means of a sliding rotary bearing 12. The adjusting ring 14 comprises an external toothing 24 which meshes with an internal toothing 24'. The internal toothing 24' is connected non-rotatably to the casing. Its centerpoint coincides with the rotational axis of the internal rotor 3. In the example embodiment the internal toothing 24' is configured on a stamped ring 27 of sheet metal which is rigidly secured to the casing part 1" or the casing part 1 (FIG. 2). The internal toothing 24' could however also be configured directly integral with the casing.

The casing together with the internal toothing 24' and the adjusting ring 14 with the external toothing 24 form an adjusting gear 20 for varying the angular position of the external rotor 4 relative to the internal rotor 3. For this purpose the internal toothing 24' comprises at least one tooth more than the external toothing 24 of the adjusting ring 14. In the example embodiment the difference in the number of teeth is precisely one. In addition, the difference in the diameter of the dedendum circle of the internal toothing 24' to that of the addendum circle of the external toothing 24 is twice the eccentricity 17.

When the adjusting ring 14 is now rotated in the direction of rotation D of the internal rotor 3 about the relatively small angle $\gamma$ with continual mutual mesh of the two toothings 24 and 24' of the adjusting gear 20, so that the addendum circle 15 of the adjusting ring 14 and the dedendum circle 16 of the internal toothing 24' roll on each other with zero slip, the rotational axis of the external rotor 4 wanders from the position as shown in FIG. 1*a* contrary to the direction of rotation of the internal rotor 3 by 90° about the rotational axis of the internal rotor 3 firstly into the position as shown in FIG. 1*b*. The position as shown in FIG. 1*b* is the zero position of the pump in which in the ideal case no fluid is delivered. In the zero position the groove ports 8 and 9 extend symmetrically on both sides of the locations of full and open mesh.

In FIG. 1*c* the pump as shown in FIGS. 1*a* and 1*b* is depicted in its second end position. In this position the fluid is delivered from the groove port 9 now effective as the low-pressure port to the groove port 9 then correspondingly effective as the high-pressure port. For this purpose the adjusting ring 14 is turned further by a further angle $\gamma$ clockwise.

The pump of the example embodiment as shown in FIGS. 1*a* to 2 is varied by mechanical actuating means. For this purpose a two-armed rocker lever 41, 43 is swivelled about an axis 42 parallelly spaced away from the rotational axis of the internal rotor 3 between two end positions, namely those as shown in FIGS. 1*a* and 1*c*. The swivel movement of the rocker lever 41, 43 is powered by motor means (not shown). The rocker lever 41, 43 is mounted in the casing part 1 clamped between the two side casing parts 1' and 1". The rotational axis 42 of the rocker lever 41, 43 is located, as viewed in the zero position shown in FIG. 1*b*, in the same plane as the rotational axis of the external rotor 3 and the rotational axis of the internal rotor 4. The front rocker lever arm 41 pointing from the rocker lever rotational axis 42 towards the two aforementioned rotational axes is coupled to the adjusting ring 14 at its front end, allowing rotation about an axis 44 parallel to the rocker lever arm 42, the axis 44 also being located in the zero position as shown in FIG. 1*b* in the aforementioned plane. From this zero position the front arm 41 of the rocker lever is swivable to both sides.

The aforementioned angle $\gamma$ is the angle by which the adjusting ring 14 turns about its own axis on actuation of the rocker lever arm 41.

In FIG. 2 the pump is shown in the section A—A of FIG. 1*b*. The rotationally driven shaft 2 is slide-mounted rotatable in the two casing parts 1' and 1" arranged juxtaposed as viewed in the longitudinal direction of the shaft 2, including between them the rotating parts of the ring gear pump and sealed off from the outside by a seal. The fluid supply and discharge are provided in the casing part 1"; the two groove ports 8 and 9 in the two casing parts 1' and 1". The adjusting ring 14 is provided only at one axial end with the external toothing 24. The ring 27 of sheet metal in turn is applied to a circular cylinder 1 which surrounds the adjusting ring 14 and forms an intermediate casing between the two casing halves 1' and 1". The inner circumferential surface area of the intermediate casing 1 and the outer circumferential surface area of the adjusting ring 14 form in their non-toothed portions rolling cylindrical surface areas 26 and 29 over which the adjusting ring 14 rolls with zero slip relative to the circular cylindrical intermediate casing 1 due to the adjusting gear 20. The pitch circles 15, 16 of the adjusting gear are located in the rolling cylindrical surface areas 26 and 29.

As viewed in the axial direction, the adjusting ring 14 comprises on the side opposite the kidney-shaped low-pressure and high-pressure ports 8, 9 a connecting groove 45 in a full or half circle closed off by the casing wall 1' which together with the connecting grooves 46 and 47 (FIG. 5) machined in the casing wall connect the expanding and contracting displacement cells 7 to each other in the region of the webs 10, 11.

Figure 3A:
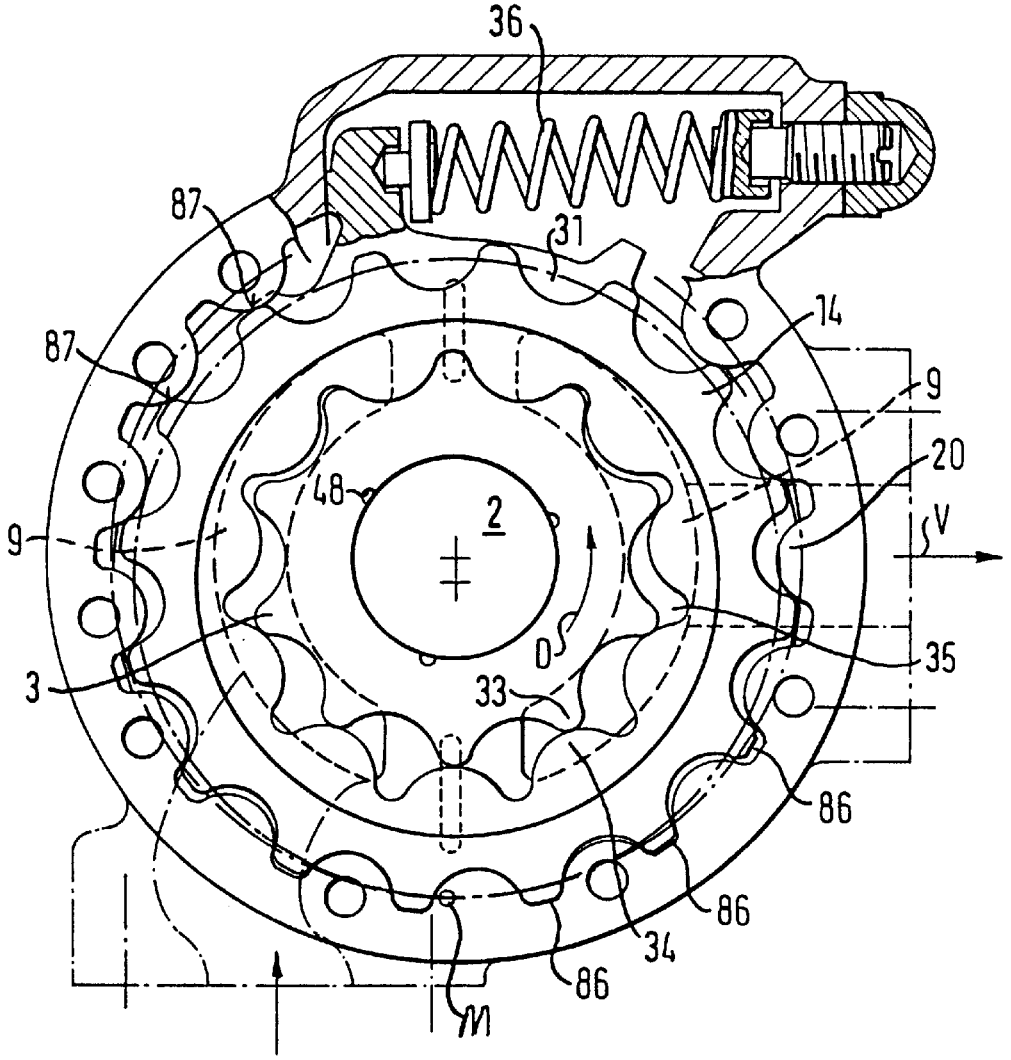
FIG. 3*a* shows a first example embodiment of a zero-stroke pump in its end position for maximum delivery.
Figure 3B:
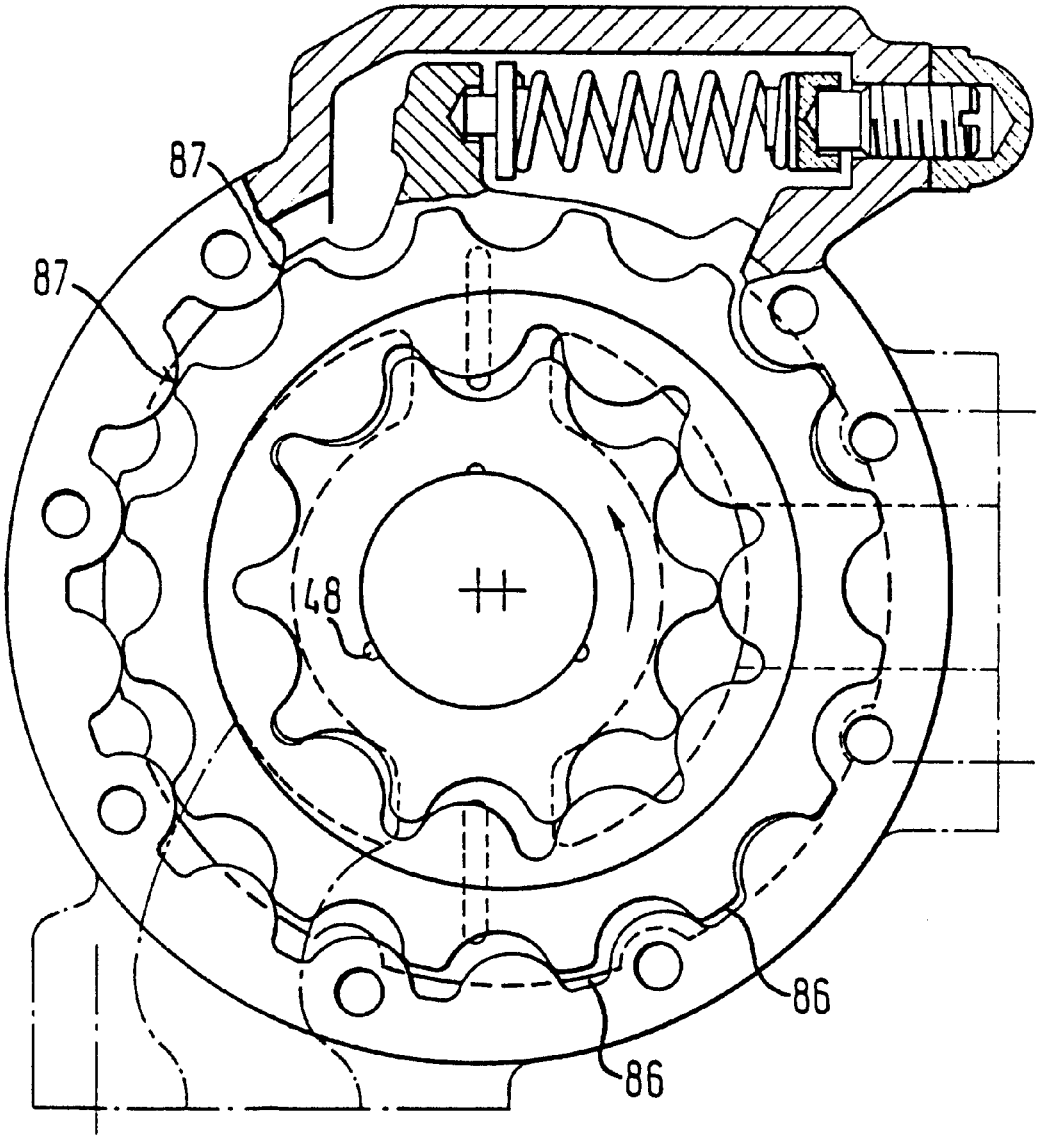
FIG. 3*b* is the zero-stroke pump of FIG. 3*a* in its zero position.

FIGS. 3*a* and 3*b* show a zero-stroke pump which is variable between a deadhead position, the zero position, and a sole end position for the maximum flow rate. In addition means are provided to limit the flow rate $\dot{V}$ with increasing speed of the internal rotor 3. For this purpose the component part formed by the adjusting ring 14 and the external rotor 4 is adjusted against the force exerted by a governor spring 36 configured as a compression spring, i.e. by utilizing the high-pressure working space 35 of the pump as the cylindrical space via the external rotor 3 as the governor piston.

The governor spring 36 is preloaded by pressure between a first non-rotatable hinge mount at the outermost circumference of the adjusting ring 14 and a second hinge mount configured as a rotary mount on the casing so that the governor spring is always biased to urge the adjusting ring 14 into its end position for maximum delivery. To enable the external rotor 4 or the adjusting ring 14 to be used as a governor piston, the high-pressure working space of the pump to be simultaneously used as the cylinder working space 35 must be located over the inner circumferential surface area of the external rotor 4 so that the adjusting ring 14 is turned against the force of the governor spring 36 in the adjusting gear 20, as a result of which the pump is automatically adjusted towards the zero position with increasing speed and thus increasing pressure at the pressure side.

Making use of the pump working space 35 as the cylinder space for varying the movement of the adjusting gear 20 makes the construction of the pump simpler.

The high-pressure working space 35 is furthermore connected to at least one space 86 between the adjusting ring 14 and the inner wall of the intermediate casing 1 at which the internal toothing of the adjusting gear 20 is also configured. The pressure field 86 thus formed over the highpressure working space 35 forces the adjusting ring 14 against the teeth 87 of the internal toothing 24' of the adjusting gear 20, these teeth being located radially opposing the pressure field 86 and the working space 35. The pressure spaces are located so that in the position as shown in FIG. 3*b* a moment sufficiently loading the spring 36 materializes relative to the momentary center M of the adjusting gear 20.

Figure 4A:
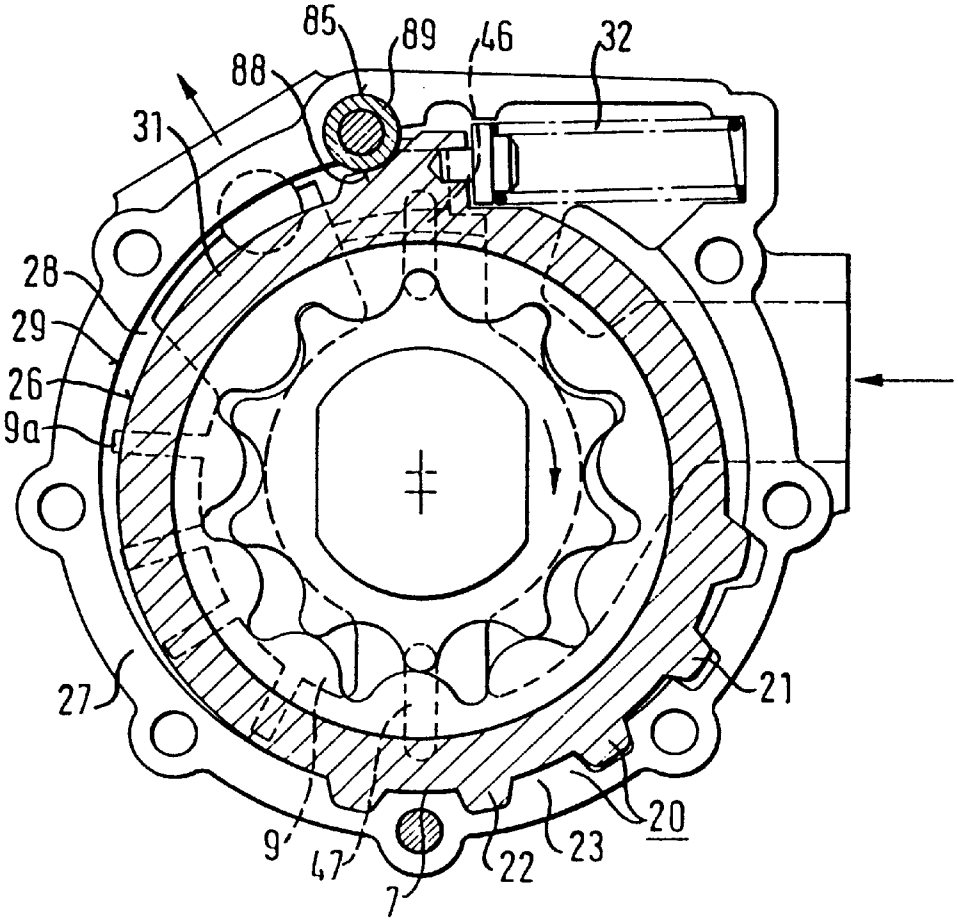
FIG. 4*a* shows a second example embodiment of a zero-stroke pump in its end position for maximum delivery.
Figure 5:
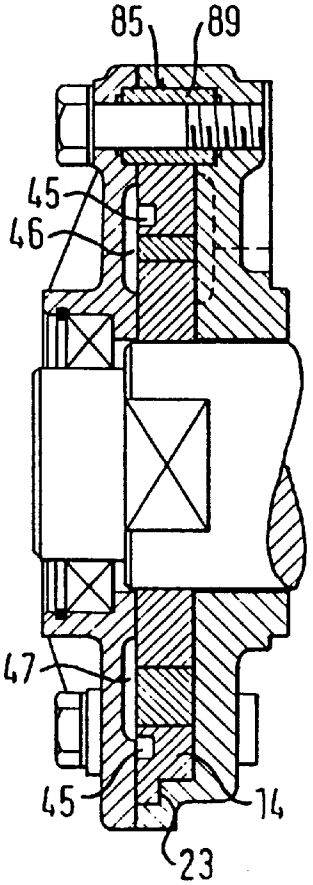
FIG. 5 is a longitudinal section through the pump as shown in FIG. 4*a*.
Figure 4B:
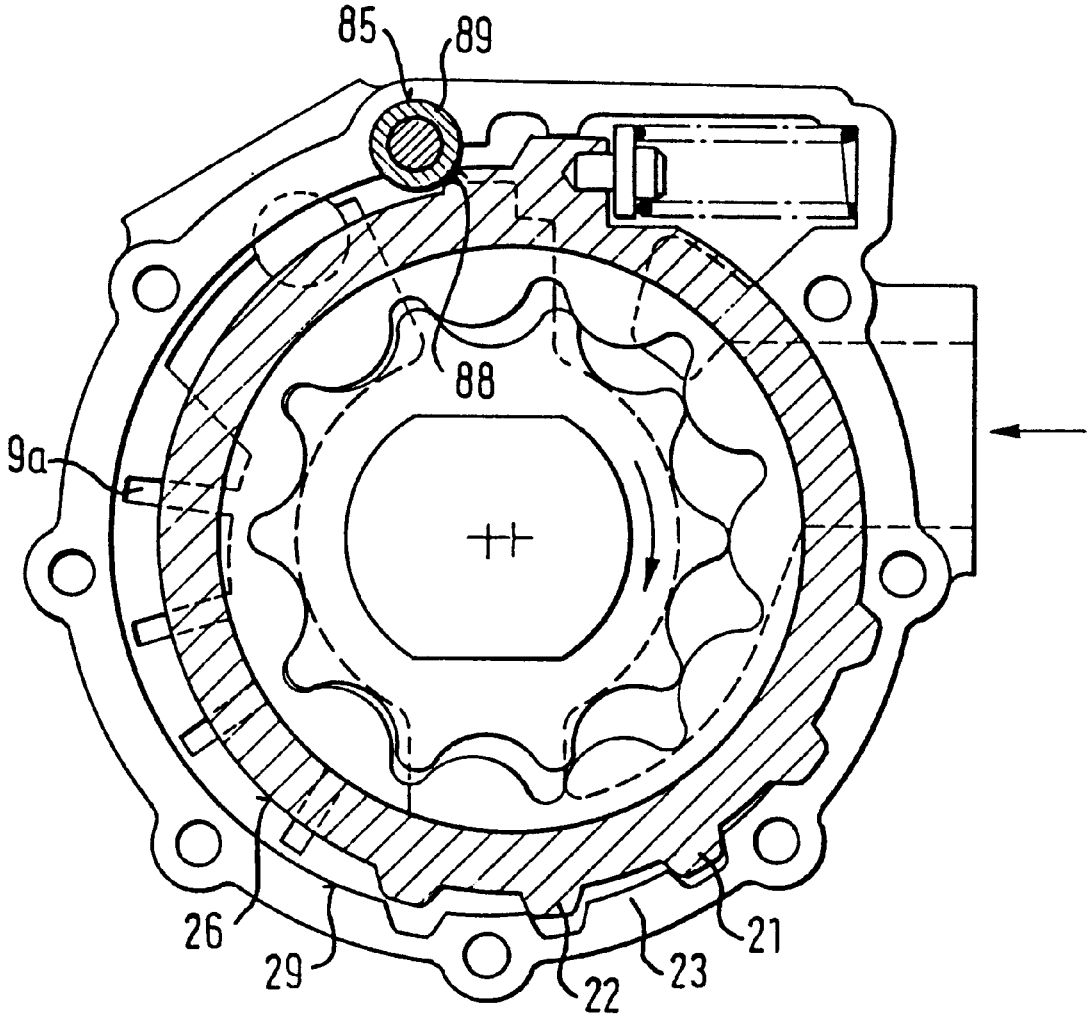
FIG. 4*b* is the zero-stroke pump as shown in FIG. 4*a* in its zero position.

Another possibility of regulating a ring gear pump with increasing speed is illustrated in the FIGS. 4*a*, 4*b* and 5. In this example embodiment the adjusting gear in this case identified 21, is furthermore configured as a partial internal gear having an adjusting ring 14 only partly provided with outer teeth and a sheet-metal ring 27 correspondingly only partly provided with inner teeth. The partial external toothing is identified by 22 and the partial internal toothing by 23. The two partial toothings 22 and 23 serve zero-slip rolling of the rolling circular surface areas 26 and 29 of the adjusting ring 14 and of the casing in the governor range.

Arranged on the casing is a sealing item 89 extending over the width of the adjusting ring 14. This sealing item 89 has a cylindrical cross-section, this being circular-cylindrical in the example embodiment. The sealing item 89 sealingly presses against a raised face or tooth tip-type location 88 opposingly configured on the adjusting ring 14 as the counter-sealing location. Sealing item 89 and raised face 88 are arranged more or less diametrally opposite the partial toothings 22 and 23 so that between the sealing location 88, 89 formed thereby and the partial toothing 22, 23 a pressure can be built up over the outer circumferential surface area of the adjusting ring 14 within a space 28, this pressure being exerted on the outer circumference of the adjusting ring 14 and thus making use of the adjusting ring as an adjusting piston against the force of a governor spring 32 comparable to the governor spring 36 of the previous example. The sealing item 89, as viewed from the governor spring 32, is mounted on the rear side of the raised face 88 configured bead-shaped for positioning the governor spring 32 on the adjusting ring to press against this raised face 89 on the casing. Acting on the rear 85 of the sealing item 89 is a fluid pressure field built up between the rear 85 of the sealing item 89 and the casing and firmly and sealingly urging the sealing item 89 against the governor spring 88 even when the former is moved under the sealing item 85 in the course of the movement of the adjusting ring 14 being varied.

The pressure space 28 employed as the adjusting cylinder is exposed to pump high-pressure over the outer circumference of the adjusting ring 14, this space 28 being located on the outer circumference of the adjusting ring 14 roughly above the high-pressure groove port 9 and is connected to the groove port 9 by radial passages 9*a* machined in the casing.

As is best evident from the longitudinal section of FIG. 5 the sealing item 89 is formed by a sealing bush which is mounted to rotate about an axis parallel to the rotational axis of the internal rotor 3. Also well evident in FIG. 5 is the connection of the expanding and contracting displacement cells of the pump by the circumferential connecting groove 45 and the two radially connecting grooves 46 and 47 as already described in conjunction with the example embodiment as shown in FIG. 1.

Illustrated in the subsequent FIGS. 6*a* to 9*c* are variable-delivery pumps which are particularly suited for application as high-pressure pumps. The teeth of the internal rotor 51 are formed by rollers 50, these being circular cylindrical rollers in the example embodiment mounted to rotate about axes parallel to the rotational axis of the internal rotor 51. The internal rotor 51 is engineered integrally with its drive shaft as is particularly evident from FIG. 6*b*.

To further reduce the forces deforming the adjusting ring 14 the toothing 52, 53 of the adjusting gear 20 extends over the full width of the adjusting ring 14, as a result of which the annulus-type casing part 55 forms at the same time together with the internal toothing 53 the intermediate casing between the two casing parts 1' and 1".

To further reduce the loads especially on the adjusting ring 14 the adjusting ring 14 is exposed to the pressure of the high-pressure side in the region of its outer circumference surface area extending over the high-pressure side of the pump as viewed radially. The outer circumferential surface area of the adjusting ring 14 extending over the low-pressure side of the pump is exposed to low pressure. For this purpose the adjusting gear 20 forms by means of its toothing 52, 53 pressure-tight chambers 56' on the high-pressure side and pressure-tight chambers 56" on the low-pressure side.

The pressure-tight chambers 56' and 56" are connected via passages 58 in one casing part 57 (FIG. 6*b*) to the pressure and suction spaces, i.e. to the high-pressure and low-pressure side of the pump. The passages 58 port into the dedendum portions of the internal toothing 53 in the intermediate casing 55. In the casing part 57 at least one connecting passage 60 leading to a groove port 9 and a further connecting passage 61 located diametrally opposed, porting into the other groove port 8, are provided.

Figure 6A:
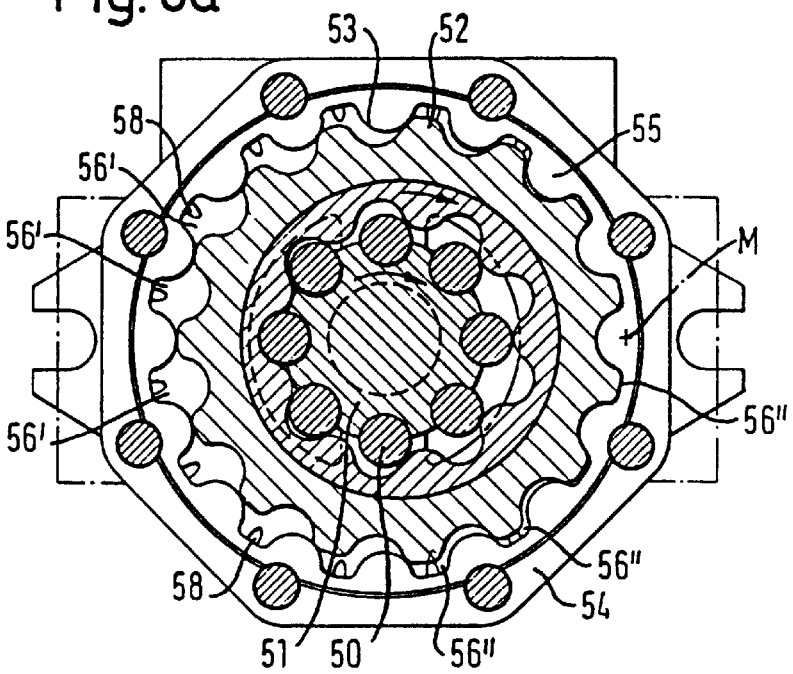
FIG. 6*a* shows a further example embodiment of a governed pump, more particularly, for high pressure applications.
Figure 6B:
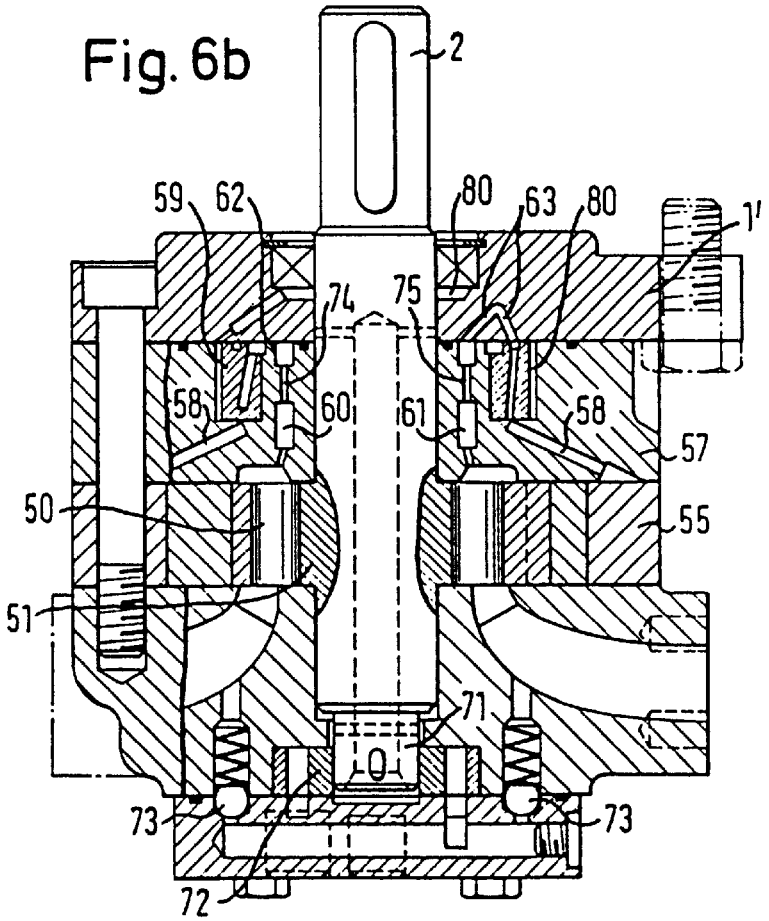
FIG. 6*b* is a longitudinal section through the pump as shown in FIG. 6*a*.

The connecting passages 60 and 61 are connected by means of a rotary control valve 59 to the passages 58. As shown in FIGS. 6*b*, 7*a* and 7*b* the rotary control valve 59 comprises a circular cylindrical rotary element which is rotationally mounted in the casing part 57 concentric to the shaft 2 and is angularly positionable in this arrangement. By connecting the passages 60 and 58 or 61 and 58 the two groove ports 8 and 9 are each correspondingly connected to their rear pressure chambers 56' and 56" formed by the toothing 52, 53 of the adjusting gear. The chambers 56' and 56" are thus exposed to the pressure of the groove port assigned thereto. The connection between the passages 60 and 58 or 61 and 58 is produced via restrictors 74 and 75 in the passages 60 and 61 and the passage end sections 62 and 63, these passage end sections 62 and 63 being in the example embodiment simple drilled passages which are connectable via connecting passages in the rotary element of the rotary control valve 59 to the passages 58 porting in the vicinity of the dedendum of the internal toothing 53.

By rotating the rotary control valve 59 the position of the chambers 56' and 56" exposed to high pressure and low pressure is changed, i.e. the chambers 56' and 56" are selectively pressurized corresponding to the angular position of the rotary control valve. In the example embodiment, as is evident from FIG. 7*a*, a further passage 77 and 79 is provided in the vicinity of the passages 60 and 61 respectively. Due to the rotary control valve 59 or the rotary element thereof and the connecting grooves provided therein the passages 60 and 61 are optionally connected to the passages 58 assigned thereto or by means of spill ports 76, 78 in the rotary element the second pair of passages 77 and 79 is connected with the leak-off spaces 80 to the tank 81, as a result of which the pressure chambers 56', 56" are optionally pressurized or connected to the leak-off spaces. Due to the pressure field in the teeth 52, 53 of the adjusting gear being variable and due to the resulting force vector being likewise able to be varied by means of the rotary control valve 59 under control at least as regards its direction such that the force vector indicates to one side of the momentary center M representing the fulcrum of the adjusting ring 14, the force vector of the partial pressure field of the chambers 56' and 56" acts on the adjusting ring 14 via the lever arm formed thereby as a varying moment. The adjusting ring 14 rotates due to the effect of this moment in its equilibrium position in which the varying moment acting from without and the moment of the working pressure field between the internal rotor and the external rotor 51, 54 are in equilibrium relative to the respective momentary center M, thus resulting in a flow rate being achieved which is oriented according to the requirement.

As illustrated in FIG. 6*b* a scavenging and variable-displacement pump 72 is arranged at the end of shaft 2 opposite the drive stub, this pump replacing the external leak-off fluid in the case of a closed circuit via check valves 73 in the low-pressure range with a greatly reduced pressure. Furthermore, the rotary control valve and the casing part 57, as indicated in FIG. 7*a*, comprise the spill ports 76, 77 as well as 78, 79 which connect the chambers 56' and 56" with the leak-off spaces 80 to the fluid reservoir.

This control arrangement is known as commutating in the case of orbit rotary piston engines. When for instance sixteen chambers 56' are provided thirty commutator ports are provided in the governor ring 59 which alternatingly connect the suction and pressure groove ports. Since such control arrangements are known in general, no further explanations are necessary in this respect.

Controlling the tilt of the rotary control valve 59 is done by means of the adjusting mechanism evident from the FIGS. 7*a* and 7*b* in which a rocker lever 64 acts similar to the way in which the rocker lever 41, 43 is used to vary the movement of the adjusting ring 14 in the example embodiment as shown in FIGS. 1*a* to 2. The rocker lever 64 is mounted in the casing to restrictedly rock about an axis oriented parallel to the rotational axis of the internal rotor 3. By one free end the rocker lever is coupled via a ball joint to the rotary element of the rotary control valve 59. This simple, straight rocker lever 64 is pivoted by its end protruding beyond its rotational axis relative to the opposite side by two linear variable-displacement means 65 which rock the rocker lever 64 about its rotational axis to and fro, as a result of which the position of the rotary element of the rotary control valve 59 is varied within a restricted angular range.

Figure 8A:
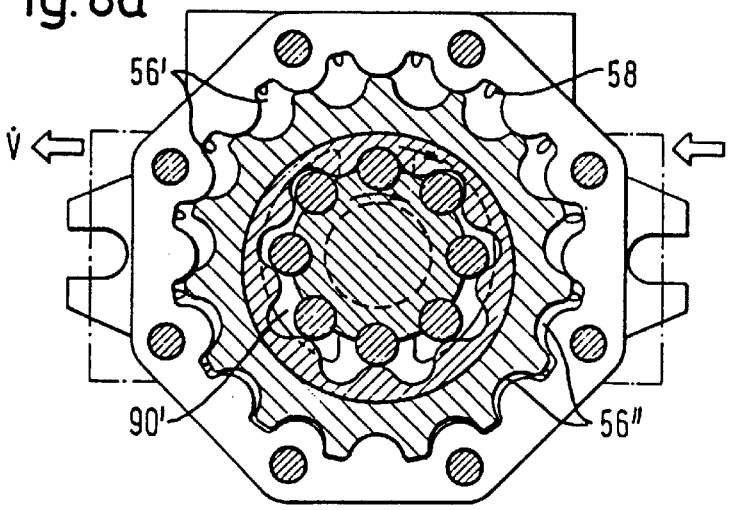
FIG. 8*a* shows the governed pump as shown in FIG. 6*a* in a first end position of maximum delivery with positive direction of delivery.
Figure 8B:
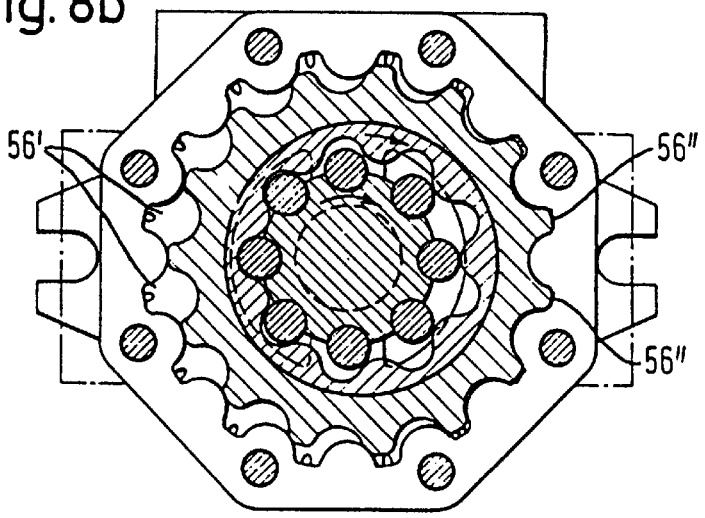
FIG. 8*b* is the pump as shown in FIG. 8*a* in its zero position.
Figure 8C:
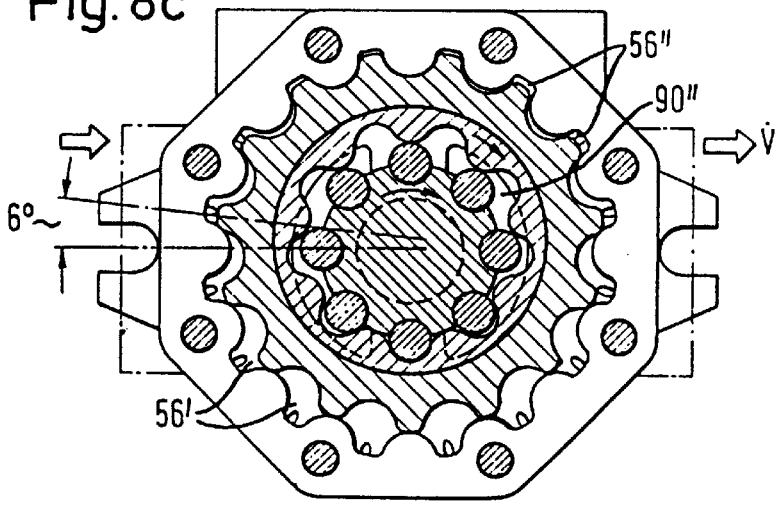
FIG. 8*c* is the pump as shown in FIGS. 8*a* and 8*b* in its second end position for maximum delivery with negative direction of delivery.

In the FIGS. 8*a* to 8*c* the end positions and the zero position of the ring gear pump according to the FIGS. 6*a* to 7*b* are depicted. The pump as shown in FIGS. 8*a* to 8*c* is configured as a high-pressure reversible pump.

Figure 9B:
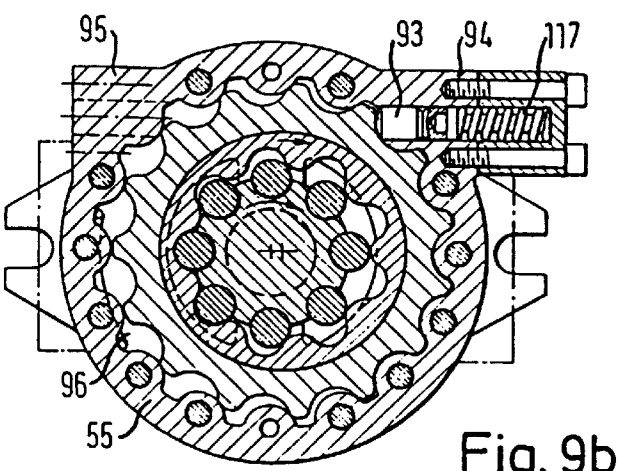
FIG. 9*b* is the pump as shown in FIG. 9*a* in its zero position and FIG. 9*c* is a longitudinal section through the pump as shown in FIGS. 9*a* and 9*b*.
Figure 9C:
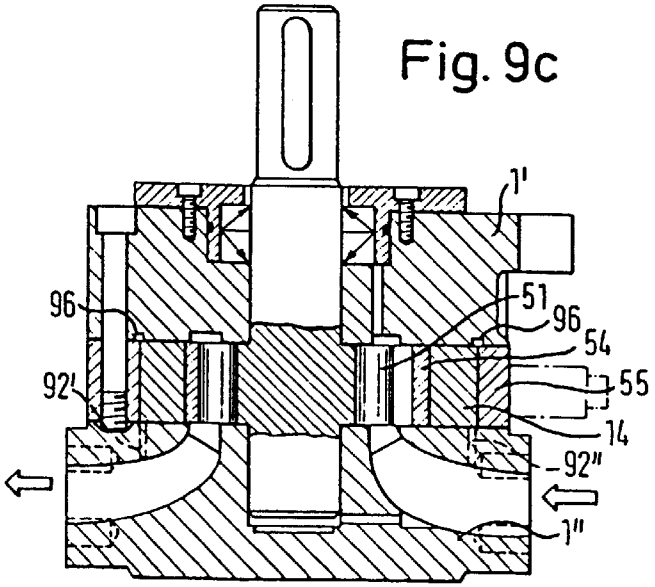
Figure 9A:
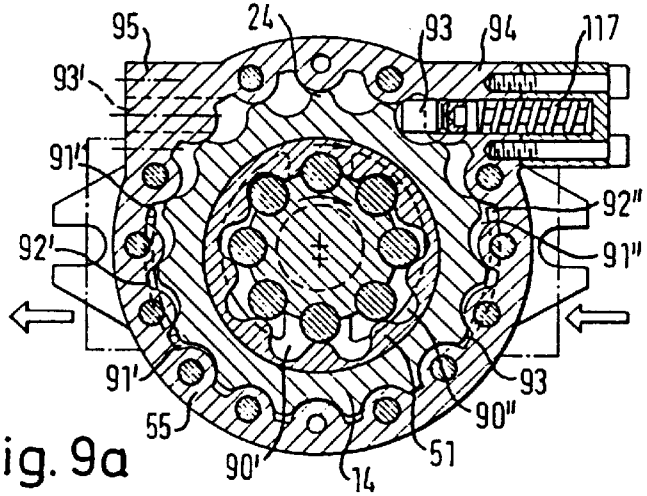
FIG. 9*a* shows a further example embodiment of a zero-stroke pump.
Figure 11:
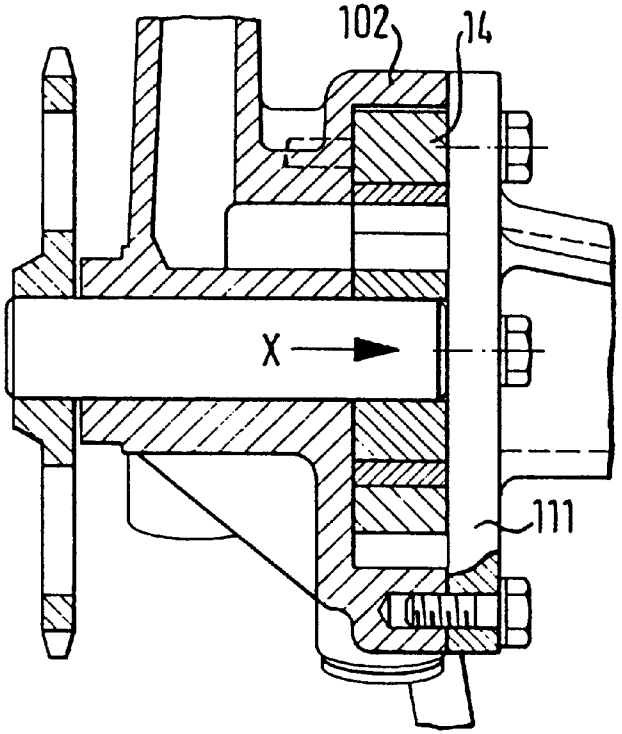
FIG. 11 is the section A—A as shown in FIG. 10.

In FIGS. 9*a* to 9*c* a high-pressure pump having automatic regulating is depicted. In the example embodiment of FIGS. 9*a* to 9*c* merely a zero-stroke pump is explicitly illustrated, having a spring-loaded member 93 on one side 94 of the casing. A second mirror-inverse arrangement of a second spring-loaded member 93' is merely suggested on the side 95 of the casing opposite that of the member 93. Due to the possible arrangement of a second spring-loaded member 93' the pump, as shown in FIGS. 9*a* to 9*c* is further configured into a zero-stroke pump for both directions of rotation. The adjusting ring 14 is biased via the member 93, on which a governor spring 117 acts, against a flank of the external toothing 24 of the adjusting ring 14 in a position for maximum delivery in one direction. The governor spring 117 acts in the same way as the governor springs 32 or 36 as already described. The second member 93', which can be likewise urged together with its governor spring from the other side against a tooth flank of the external toothing 24, forces the adjusting ring 14 in the direction of maximum delivery in the opposite direction. In this arrangement either the one member 93 or the other member 93', depending on the direction of rotation, is in flank engagement with the external toothing 24. By the members 93 and 93' being pliantly urged against their respective tooth flanks of the external toothing 24 a zero-stroke pump having automatic regulating materializes in keeping with the example embodiments as shown in FIGS. 3*a* to 4*a*. The zero-stroke pump can be prepared by the manufacturer so that it can be incorporated as either a counter-clockwise or clockwise rotating pump depending on the circumstances at the final location by the casing being prepared for both directions of rotation and simply incorporating the member together with the spring as necessary for the desired direction of rotation. This pump could even be further configured into a reversible pump by an adjusting mechanism, for instance a positioning cylinder acting on the governor spring 117 thereby controlling the change in position of the governor spring 117.

As already described relative to FIGS. 6*a* to 8*c* the adjusting ring 14 is pressurized at its outer circumferential surface area by chambers 91' and 91" connected to the high-pressure side and the low-pressure side being formed by the toothing 24, 24' of the adjusting gear. For this purpose the high-pressure side and the low-pressure side are connected via chambers 92' and 92", porting into the dedendum of the external toothing 24', to the respective chambers 91' and 91". By at least one groove 96 provided on the high-pressure side—in the case of a reversible pump thus on both sides—in the casing and connecting several of the chambers 91' or 91" to each other a particularly good, smooth adaptation of the outer pressurization of the adjusting ring 14 is achieved.

The force acting on the adjusting ring 14 due to the pressure existing in the pump working spaces 90' and 90" is smaller than the force exerted on the adjusting ring 14 due to the pressure in the outer pressure spaces 91' and 91", this applying likewise to the other pumps having automatic regulating by means of such pressure fields. This is achieved by the pressurized radially effective surface area in the working spaces 90' and 90" being smaller than the radially effective surface area of the pressure spaces 91' and 91". The position of the adjusting ring 14 is thus dictated by the resulting force vector as a result of the pressure in the working spaces 90' and 90" and in the pressure spaces 91' and 91".

Figure 10:
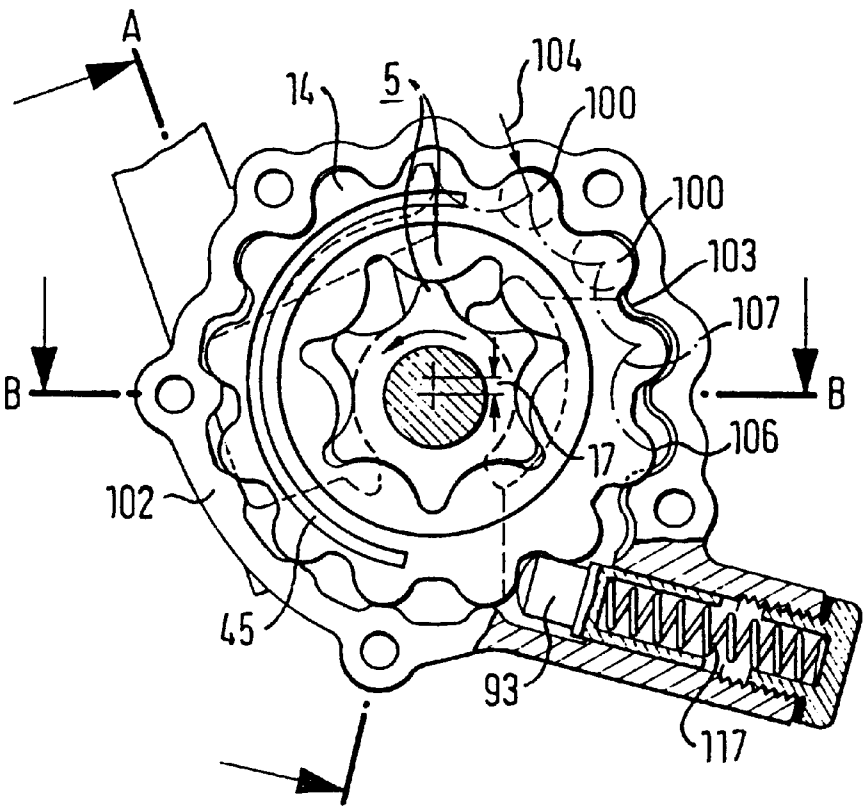
FIG. 10 shows a variant of the example embodiment as shown in FIG. 9*a*.
Figure 13:
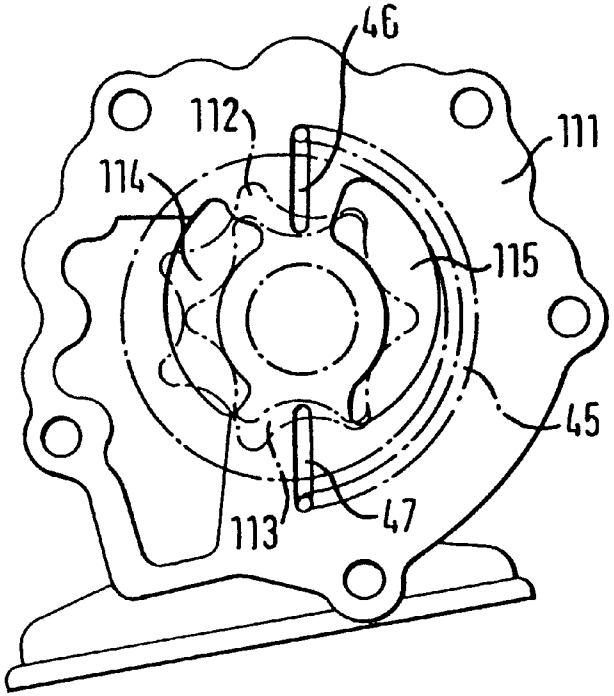
FIG. 13 is the view X as shown in FIG. 11.
Figure 12:
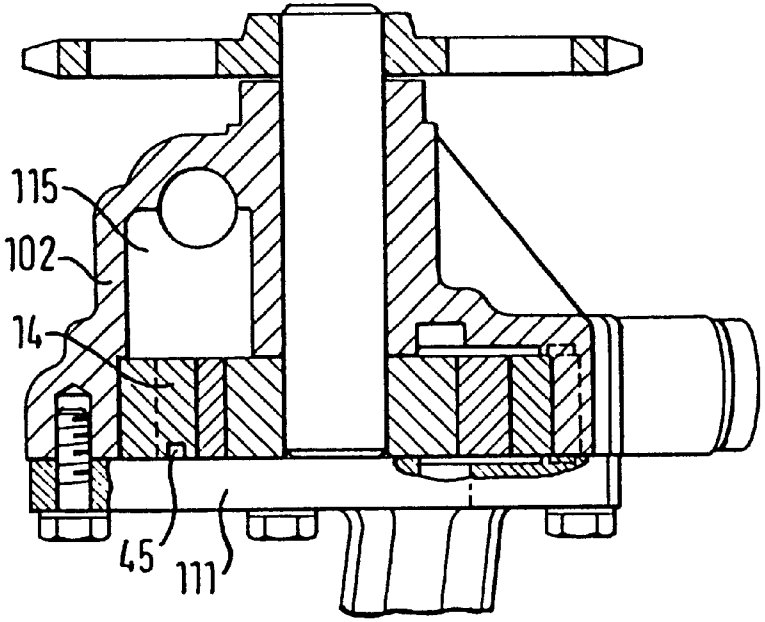
FIG. 12 is the section B—B as shown in FIG. 10.

In FIG. 10 a variant of the zero-stroke or reversible pump having automatic regulating as shown in FIGS. 9*a*—9*c* is illustrated, whereby the teeth of the internal rotor are again configured integrally with the internal rotor. To facilitate manufacturing the toothing between the adjusting ring 14 and the casing part 102, the external toothings 100 are circular or partly circular in shape in the cross-section of the adjusting ring 14, this facilitating, more particularly, the manufacture of the mating toothing 103 on the casing 102. The mating toothing 103 is shaped by means of a high-speed shell mill, the radius of which equals the radius 104 of the external toothing 100. The rotational axis of the shell mill, i.e. its longitudinal centerline is guided on a hypocycloid having the same eccentricity 17 as that of the adjusting ring 14. The casing part 102 can thus be manufactured initially as an integral die casting without the intermediate casing, the toothing 103 then being machined by the milling procedure as described. In this way the casing part 102 comprising the internal toothing of the adjusting gear can be produced particularly cost-effectively.

In the example embodiment as shown in FIGS. 10 to 13 the casing is two-part, i.e. with the casing part 102 comprising the internal toothing and a cover part 111. As in the example embodiments as already described it is basically possible to produce the casing part 102 also again in two parts, i.e. with an intermediate casing part comparable to the casing parts 55 as described above.

In the example embodiment as shown in FIGS. 10 to 13 the adjusting ring 14 again comprises on at least one of its axial sides a circumferential groove 45 which produces, via the two further axial grooves 46 and 47 which are configured in turn preferably in the cover-like casing part 111 in the region of the webs between the suction portion 114 and the pressure portion 115, a passage connection between the entrapment space 112 and the cavitation space 113. The pump itself is automatically regulated by means of a governor spring 117. As already explained in the example embodiment as shown in FIGS. 9*a*—9*c* the governor spring 117 acts via a member 93 on the external toothing 100 of the adjusting ring 14. In configuring a reversing pump having automatic regulating, here too, a second governor spring 117 may be provided.

The governor spring 117 may be preferably furthermore configured to form a governor spring system including at least two springs connected in series. In this way the pump in accordance with the invention may be formed with a delivery characteristic in which the pump features a quickly increasing flow rate within a first pump speed range, this flow rate being proportional to the speed of the pump in a first approximation, being, within a second higher speed range, quickly regulated towards the zero position until a preset pump speed is reached, and again increasing more quickly with pump speed in a third speed range higher in speed than the second speed range and subsequent thereto.

A delivery characteristic of this kind is particularly of advantage for applications in motor vehicles in which a pump in accordance with the invention is driven by the vehicle engine, the pressure side thus having a fixed relationship to the engine speed. Motor vehicles require in the lower engine speed range, i.e. as of starting, large amounts of oil directly. After having achieved a prescribed engine speed and thus the pump speed and delivery involved no, or no further, appreciable increase in the flow rate of the pump is required via the speed range subsequent to the prescribed engine speed. Were the flow rate to further increase with no restriction on increasing pump speed, delivery would be in excess of the actual requirement with a correspondingly unnecessarily high power demand for the pump. After passing through the middle speed range, this generally being the main operating range of the engine, a higher oil flow rate is needed at higher engine speeds due to these involving higher centrifugal forces at the locations to be lubricated, for example, at the crankshaft. To overcome these centrifugal forces gaining in significance a higher oil pressure is required. In general the three speed ranges to be distinguished in the case of passenger motor vehicles are the lower engine speed range from 0 to approximately 1,500 RPM, followed by the main operating range from approximately 1,500 to approximately 4,000 RPM and the third higher engine speed range as of approximately 4,000 RPM.

To achieve the desired delivery characteristic, namely with a steep increase in the flow rate in the lower speed range, followed by a relatively slow increase or even zero increase in the middle speed range and in conclusion again with a steeper increase in the upper speed range a soft first governor spring is connected in series to a second governor spring which is harder as compared to the former, both forming a governor spring system 117. The governor spring system 117 as shown in the FIGS. 9*a*—9*c* or FIG. 10, basically also the governor spring 36 as shown in FIGS. 3*a* to 4*b* are employed to achieve this delivery characteristic by the two cited governor springs. The governor spring system 117 is installed preloaded so that there is hardly any compliance in the lower speed range. As soon as the preloading force is exceeded at the transition from the lower speed range to the middle speed range the first soft space commences its spring action until at the upper end of the middle speed range it comes up against the harder second governor spring to stop. With a further increase in speed the delivery characteristic is then dictated by the harder second governor spring.

When put to use as the oil pump for internal combustion engines, more particularly for motor vehicles, the pump in accordance with the invention may be employed not only as the lube pump, it may also be used to advantage to pump the oil for a hydraulic compensation of valve play and/or as a pump for varying the valve timing. For these applications it may be employed for each application on its own or in combination. However, the pump in accordance with the invention is suitable for these purposes basically in all of the variants described, since it can be adapted with high accuracy basically to any desired delivery characteristic due to it being infinitely variable.

What is claimed is:

1. An infinitely variable ring gear pump comprising a stationary casing, an internal rotor (3) in the casing rotatably supported and driven by means of a shaft (2) and an external rotor (4) likewise rotatably supported, meshing with said internal rotor (3), a gear running set formed by external teeth of the internal rotor and internal teeth of the external rotor, the difference in the number of teeth of the gear ring running set (5) being equal to unity, having a tooth shape in which a plurality of expanding and contracting displacement cells (7) each sealed off from the other materializes due to tooth tip contact, and an adjusting gear (20; 21) being formed by an external toothing (24; 22; 52; 100) on an adjusting ring (14) and an internal toothing (24'; 23; 53; 103) of said casing, the external toothing (24; 22; 52; 100) meshing with the internal toothing (24'; 23; 53; 103), and kidney-shaped low and high pressure ports (8, 9) fixedly arranged laterally in the region of said displacement cells (7) being provided in the casing, said ports being separated from each other by webs (10, 11) and the angular position of the eccentric axis (eccentricity 17) of said ring gear running set (5) being variable relative to the casing, the support (12) of said external rotor (4) of said ring gear running set (5) occurring at an outer diameter (13) of the latter in said adjusting ring (14) the same in width, the adjusting gear (20; 21) being configured as a complete or partial internal gear (24, 24'; 22, 23; 52, 53; 100, 103) having the same eccentricity (17) as said ring sear running set (5) whereby the adjusting ring (14) is rollable with zero slip by its outer circumferential or pitch circle (15) on an inner circumferential or pitch circle (16) of said casing, the difference in the diameters of said two circumferential or pitch circles (15, 16) being twice the eccentricity (17) of said ring gear running set (5).

2. The ring gear pump as set forth in claim 1, wherein said internal toothing featuring for flank engagement with the external toothing at least one, tooth more than said external toothing, this difference in the case of only partial toothings being related to toothings imagined to be fully circumferential.

3. The ring gear pump as set forth in claim 1, wherein the teeth (24; 22; 52; 100) of an external toothing for forming an adjusting gear (20; 21) affecting the zero-slip rolling action are arranged only laterally on said adjusting ring (14), and the remaining width of said adjusting ring (14) serves as a rolling cylindrical surface area (26, 29).

4. The ring gear pump as set forth in claim 1, wherein for forming a zero-stroke pump a space (28) between a wall of said casing forming said inner circumferential circle (16) and a wall of said adjusting ring (14) forming said outer circumferential circle (15) is pressurized on the pressure side and said adjusting ring 14) is used as an adjusting piston (31) acting against a governor spring (32) for actuating the governing rolling movement of said adjusting ring (14).

5. The ring gear pump as set forth in claim 1, wherein for forming a reversible pump means (40, 41, 42, 43, 44) are provided permitting mechanical actuation of said governing rolling movement of said adjusting ring (14) in both directions from the deadhead position (zero position) of said ring gear pump into the delivery position.

6. The ring gear pump as set forth in claim 1, wherein between said adjusting ring (14) and said casing at least one sealed radially acting pressure field (86) connected to said high pressure is arranged, this pressure field sealingly urging said adjusting ring (14) at the opposite side as viewed radially by its tooth tips (87) or tooth-tip similar parts (88) against the tooth tips or tooth-tip similar parts (89) of said casing.

7. The ring gear pump as set forth in claim 1, wherein on said casing at least one sealing member (89) is provided, said sealing member comprising on its rear (85) between said casing and said sealing member at least one sealed pressure field sealing urging said at least one sealing member (89) against said tooth tip(s) or tooth-tip similar parts (88) of said adjusting ring (14), by being exposed to high pressure.

8. The ring gear pump as set forth in claim 1, wherein for forming a zero-stroke pump the pressure-building working space (35) is effective as an adjusting cylinder over said external rotor (4) on said adjusting ring (14) and a governor spring (36) is provided biased to move said adjusting ring (14) in the direction of maximum displacement.

9. The ring gear pump as set forth in claim 1, more particularly for high working pressure, wherein said teeth of said ring gear running set (5) forming said displacement cells are configured on one of said two rotors (51, 54) as rollers (50), said rollers being rotatably mounted in said respective rotor (51, 54).

10. The ring gear pump as set forth in claim 1, wherein the toothing (24, 24'; 22, 223; 52, 53; 100, 103) of said adjusting gear (20; 21) extends over the full width of said ring gear running set (5).

11. The ring gear pump as set forth in claim 1, wherein said adjusting gear forms pressure-tight chambers (56', 56"), which are in a casing part (57) in connection via passages (58) with the pressure and suction spaces respectively of said pump.

12. The ring gear pump as set forth in claim 1, wherein via a rotary control valve (59) said chambers (56', 56") can be exposed both in number and in location each oppositely to high pressure and low pressure via passages (58, 60, 61, 62, 63).

13. The ring gear pump as set forth in claim 11, wherein the sum of surface areas exposed to high pressure in said pressure chambers (56', 56") between said adjusting ring (14) and said casing has a smaller force effect than the sum of the surface areas exposed to pressure in the working chambers (35) in said pump toothing.

14. The ring gear pump as set forth in claim 1, wherein for forming a zero-stroke pump a spring force strives to turn said adjusting ring (14) in the direction of maximum delivery; said spring force being transmitted by means of a pressure member (93) to a tooth flank (94) of said external toothing (24; 100) of said adjusting ring (14).

15. The ring gear pump as set forth in claim 1, wherein several tooth chambers (91") located on the pressure side between said internal toothing of said casing part (55) forming said adjusting gear and said external toothing of said adjusting ring (14) are connected via passages (92') to the high pressure and said tooth chambers (91") located correspondingly oppositely are connected to the low pressure via passages (92").

16. The ring gear pump as set forth in claim 14, wherein said passages (92') are arranged so that they are cut off from and/or connected to the high pressure one after the other on a reduction in displacement by the rotatory movement of said adjusting ring (14).

17. The ring gear pump as set forth in claim 14, wherein pressure members (93) are arranged on both sides (94, 95) of said casing, said pressure members (93) being actuatable by an adjusting cylinder for forming a reversible pump.

18. The ring gear pump as set forth in claim 14, wherein in the region of said adjusting gear (20, 21) between said adjusting ring (14) and said casing (1; 55) grooves (96) are machined in the laterally arranged casing part (1') oriented circumferentially, said grooves connecting tooth chambers (91', 91") of said toothing (24, 24') to each other on the high-pressure side or on the low-pressure side or on both sides in a suitable length for tuning the hydraulic forces in these areas.

19. The ring gear pump as set forth in claim 14, wherein a governor spring system (117) for generating the spring force comprises at least two springs, and in a first regulating range a soft spring characteristic having a small increase in force and in a subsequent second regulating range another characteristic having a larger increase in force is provided via the governor path.

20. The ring gear pump as set forth in claim 1, wherein said adjusting ring (14) comprises on at least one axial side a circumferential groove (45) producing via at least two further axial grooves (46, 47) arranged in a cover-like casing part (111) a passage connection between the entrapment space (112) and the cavitation space (113) in the web portions between said suction portion (114) and said pressure portion (115).

21. The ring gear pump as set forth in claim 1, wherein said adjusting ring (14) comprises circular external toothing (100) on its outer diameter for forming said adjusting gear and said casing (102) is formed as an internal toothing (103) by rolling action of said adjusting ring (14) having said eccentricity (17) in common with that of said ring gear running set (5).

22. A method of producing the ring gear pump as set forth in claim 21, wherein said casing (102) is produced by die-casting and said tooth shape of said internal toothing (103) is formed by means of a milling cutter.

23. The ring gear pump as set forth in claim 1, wherein said pump is used to supply a hydraulically actuated adjusting means for setting and varying the valve timing control of a valve-controlled internal combustion engine.

* * * * *